US010842301B2

(12) United States Patent
Werner

(10) Patent No.: US 10,842,301 B2
(45) Date of Patent: Nov. 24, 2020

(54) COOLING PILLOW

(71) Applicant: Marc L. Werner, Plantation, FL (US)

(72) Inventor: Marc L. Werner, Plantation, FL (US)

(73) Assignee: Werner Media Partners LLC, Plantation, FL (US)

( * ) Notice: Subject to any disclaimer, the term of this patent is extended or adjusted under 35 U.S.C. 154(b) by 0 days.

(21) Appl. No.: 15/719,475

(22) Filed: Sep. 28, 2017

(65) Prior Publication Data

US 2018/0140116 A1 May 24, 2018

Related U.S. Application Data

(60) Provisional application No. 62/367,840, filed on Jul. 28, 2016.

(51) Int. Cl.
*A47G 9/10* (2006.01)
*A47G 9/02* (2006.01)

(52) U.S. Cl.
CPC ..... *A47G 9/1036* (2013.01); *A47G 9/0253* (2013.01); *A47G 2009/1018* (2013.01)

(58) Field of Classification Search
CPC ..... A47G 9/10
USPC ..... 5/636, 638
See application file for complete search history.

(56) References Cited

U.S. PATENT DOCUMENTS 5,033,136 A * 7/1991 Elkins ..... A47C 21/048 5/421
5,388,296 A * 2/1995 Mansour ..... A47C 21/046 5/484
2003/0109908 A1* 6/2003 Lachenbruch ..... A47C 21/046 607/96
2004/0123391 A1* 7/2004 Call ..... A61G 5/1043 5/630
2012/0227185 A1* 9/2012 Batiste ..... A47G 9/007 5/641
2015/0272354 A1* 10/2015 Asklof ..... A47G 9/1036 5/636

* cited by examiner

*Primary Examiner* — Frederick C Conley
(74) *Attorney, Agent, or Firm* — Pearson IP; Loren Donald Pearson

(57) ABSTRACT

A cooling pillow generates a gust of cooled air when compressed. A solid, resilient, compressible foam block forms a core of the cooling pillow. A phase change material layer adhered to a surface of the foam block. Holes can be formed in the foam block to enhance the feel of the pillow and to improve the speed at which air is displaced when the cooling pillow is compressed. A pillow protector encloses of lightweight breathable material encloses the foam block. The pillow protector prevents the foam block and cooling layer from being abraded during insertion and removal from a pillow case. The pillow case encloses the pillow protector, which in tour holds the foam block and cooling layer. The pillow case has a breathable surface. The breathable surface is oriented to overly the cooling layer. A performance material can be used to form the breathable surface. To use the cooling pillow, the cooling pillow is oriented with the cooling layer and the breathable surface facing upward. The user then rests his or her head on the top of the pillow and compresses the cooling pillow with the weight of his or her head. As the pillow compresses, air is displaced and is cooled by the phase change material in the cooling layer. The result is a gust of cooled air against the user's head and neck.

2 Claims, 9 Drawing Sheets

COOLING PILLOW

CROSS-REFERENCE TO RELATED APPLICATIONS

This application claims the benefit of U.S. Provisional Application No. 62/367,840, filed Jul. 28, 2016, which is hereby incorporated by reference.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention relates to bedding, and in particular to pillows with cooling features.

Description of the Related Art

Obtaining quality sleep is an essential component of both maintaining and improving one's health. While sleeping, people pass through five phases of sleep: stages 1, 2, 3, 4, and REM (rapid eye movement) sleep. These stages progress in a cycle from stage 1 to REM sleep, then the cycle starts over again with stage 1. People lose some of the ability to regulate their body temperature during REM, so abnormally hot or cold temperatures in the environment can disrupt this stage of sleep. Having suitable bedding is critical in controlling temperature, which ultimately, when adequate, can enhance the quality of sleep that one receives.

When the temperature around the body's microclimate stays balanced, the sleeper awakens less, sleeps deeper, and gets a better more restorative sleep. Today, many people suffer from waking in the middle of the night due to temperature fluctuations.

One significant area of importance for temperature balance is at one's head. Commonly, when sleeping, individuals rest their head on a pillow. Traditional pillows are composed of a variety of materials, but such materials lack the ability to regulate one's sleep at a lower, more comfortable temperature.

Previous attempts at reducing temperature with modified pillows incorporating phase change material (PCM) have been unsuccessful. These prior attempts look to incorporate phase change material into the chemical composition of the cushion prior to pillow formation.

By mixing phase change material into the chemical composition prior to pillow formation, the phase change material is diluted and the abilities of the PCM are reduced.

In addition, by mixing phase change material into an interior of a volume of foam, discreet locations containing PCM are surrounded by foam. The surrounding foam acts as a thermal insulator that inhibits heat exchange between the discreet PCM locations and a person resting on the surface of the foam.

MacKay (US Pat. Pub. 2012/0193572) teaches dispersing the phase change material within the foam of bedding. No detail is provided regarding the application of a layer of phase change material upon the surface of the bedding. The usefulness of the phase change material in regulating the temperature is thus reduced in the pillows according to MacKay.

A phase-change material (PCM) is a substance that has a high heat of fusion and that is capable of storing and releasing large amounts of energy by melting and solidifying at certain temperatures. Heat is absorbed or released when the material changes from solid to liquid and vice versa; thus, PCMs are classified as latent heat storage (LHS) units.

Accordingly, a PCM that melts below body temperature would feel cool as it absorbs heat, for example, from a body. The melting and freezing of the material takes place over a narrow temperature range, thereby allowing small changes in temperature to cause reactions.

PCMs have been used in the inclusion of the chemical composition of foam pillows, but due to diluting of the advantageous properties of the PCM, the user is unable to feel the full extent of the coolness that PCMs are capable of achieving.

Pillow covers and pillow protectors protect an enclosed pillow during use. A pillow cover inhibits moisture such as perspiration and saliva, from reaching the enclosed pillow. The pillow cover acts as a pouch for holding the pillow. A zipper is included to open and close the pouch. The pillow cover can be removed from the pillow and washed separately from the pillow, which may not be washable. The pillow cover also typically costs less than a pillow. The pillow cover can be removed and disposed when soiled and the enclosed pillow can be saved and reused. A pillow cover is typically made from a cotton textile similar to a sheet and sometimes includes a waterproof membrane made of polyurethane. Traditional pillow covers have the unintended affect of inhibiting airflow and decreasing the breathability of the enclosed pillow.

A pillow case or pillow cover is an exterior pouch in which the pillow and the pillow cover are placed. The pillow case adds decorative features to a pillow and can be easily washed by removing the pillow and the pillow cover. Pillow cases are made of cotton fabric. A problem with traditional pillow cases is that they inhibit airflow and decrease the breathability of the enclosed pillow.

As shown by the review of the prior art, a need exists to provide supportive bedding that improves a sleeper's temperature regulation, particularly when first falling asleep.

BRIEF SUMMARY OF THE INVENTION

An object of the present invention is to provide a cooling pillow that incorporates phase change material to produce a cooled surface when a sleeper rests his or her head on the pillow.

A further object of the present invention is to provide a pillow that creates a flow of air when the pillow is compressing. "Compressing" in this context means while being reduced in volume, as contrasted to "compressed", which means staying at a constant, compressed volume.

A further object of the present invention is to provide a pillow that creates a flow of cooled air when the pillow is compressing.

A block of solid, resilient, compressible foam forms a core of the cooling pillow. The foam block can be made from polyurethane foam, visco elastic foam, and gel infused polyurethane foam. Alternative foams include natural latex and synthetic latex foams. Suitable foams can have densities between 40 and 64 g/l. An overly firm pillow will neither compress sufficiently nor auto adjust under the weight of the sleeper's head. An overly plush pillow flattens under the weight of sleeper's head and remains compressed after removing one's head. A satisfactory pillow will have a response time between four and eight seconds (4-8 s). Response time can be a measure of the time for pillow to be depressed under a weight of a typical head or the time for the pillow to recover when the weight is removed.

A block of solid, resilient, compressible foam is made by mixing the materials for the foam, spraying the mixture with a gas to form a liquid foam, filling a mold with the liquid foam, and curing the liquid foam to form a solid foam. In the case of a polyurethane foam, a liquid polyol component is mixed with a liquid isocyanate component. The components are selected based on the desired physical properties of the foam. Modifiers can be further added to help achieve the desired physical properties and to aid in processing. Next, the mixture is sprayed from a nozzle into a mold. Carbon dioxide is sprayed from a second nozzle into the steam of sprayed mixture to produce a liquid foam. The mold has a cavity shaped like the shape of a pillow when closed. After filling the mold with the liquid foam, the mold is closed and the liquid foam is heated to 51.7° C. and cured for ten to twelve minutes. After curing, the mold is opened and a cast is removed. The cast is a block of solid, resilient, compressible foam, which can be further processed.

While a foam block according to the invention can have any size, a block that is sized to meet existing standard sizes can be particularly useful. For example, a block that is 41 cm long, 61 cm wide, and 14 cm thick can be used to form a pillow.

Cracking a foam block has been found to enhance the comfort and feel in bedding. Cracking is a term for processing a foam block with a roller press. A block of solid, resilient, compressible foam is passed through a roller press twice. While a foam block that has been rolled once has improved compression and resilience characteristics, passing the foam block through the roller twice provides optimal characteristics. The roller press opens some of the closed cells that make up the foam block. A foam block that has been cracked has a compressibility and resilience that allows the resulting pillow to be usable by back, side, and stomach sleepers.

Perforations are formed in the solid, resilient, compressible foam block to increase a volume of air being evacuated through the perforated surface when the foam block is compressed. Increasing the size or number of perforations increases the volume of air being evacuated through the perforated surface. In addition, increasing the size or number of perforations increases the compressibility of the foam block. Decreasing the spacing between perforations increases the volume of air being evacuated through the perforated surface. In addition, decreasing the spacing between perforations increases the compressibility of the foam block. Shaping the perforations with wider openings near a surface, increases the compressibility of the foam block nearer the surface. Forming perforations through the foam block inline with the direction of compression, increases the volume of air through the surface compared to perforations that do not go through the block.

Accordingly, a further object of the invention is to provide a plurality of perforation in a surface of a foam block that maximize a volume of air passed through the surface when the foam block is compressed. At the same time, a further object of the invention to provide a pillow that is not too compressible that the foam block will be fully compressed during normal use.

A further object of the invention is maximizing airflow through a PCM-coated surface without compromising the supportiveness of the bedding. Perforations can be formed in the solid, resilient, compressible foam block that have larger diameters near the surface and narrower diameter from the diameter. Perforations with this shape cause the foam block to be more compressible near the surface and increasingly resilient as the foam block is compressed.

Perforations made according to the following process result in bedding with improved cooling and performance compared to pillows made with other methods, particularly, molding. According to the process, the solid, resilient, compressible foam block is compressed into a flat state by applying pressure to the surface that is to have the cooling properties. Next holes are punched through the compressed foam block. The punch itself can have a conical or frusto-conical shape to create the increasing diameter perforations.

As stated, an object of the invention is maximizing air flow through the surface with PCM material, while maintaining the comfort and supportiveness of the bedding. Two of the factors that affect both the air flow and the comfort and supportiveness of the bedding are the number of perforations and the size of the perforations. It has been found that the volume of perforations being compressed is proportional to the volume of air being blown past the PCM-containing surface. At the same time, good performing bedding is known to compress to a height that places the sleepers skeleton inline under the weight of the body, while retaining a recovery time between four and eight seconds (4-8 s). Recovery time is the time required for the solid, resilient, compressible foam block to return to an uncompressed state after normal use. The compressibility of the solid, resilient, compressible foam block increases with the volume of perforations being compressed. So, if too much of the volume of the solid, compressible, resilient foam block is perforations, then the bedding will be too compressible and will sag to a point that moves the resting body out of alignment. Accordingly, an object of the invention is to provide bedding with a maximized volume of perforations that does not have too much compressibility.

A further object of the invention is to provide bedding with a good feel. A proper combination of compressibility and resilience in bedding contributes to what is subjectively called "Good Feel". Bad feel is experienced in bedding that does not auto adjust to person's size, weight, and shape. A good feel is described to be like a person resting in a pool of water in a neutrally buoyant state.

A phase change material (PCM) is a substance with a high heat of fusion which, melting and solidifying at a certain temperature, is capable of storing and releasing large amounts of energy. Heat is absorbed or released when the material changes from solid to liquid and vice versa; thus, PCMs are classified as latent heat storage (LHS) units.

Latent heat storage can be achieved through liquid to solid, solid to liquid, solid to gas, and liquid to gas phase changes. However, only solid to liquid and liquid to solid phase changes are practical for PCMs.

Initially, solid-liquid PCMs behave like sensible heat storage (SHS) materials; their temperature rises as they absorb heat. Unlike conventional SHS materials, however, when PCMs reach the temperature at which they change phase (their melting temperature) they absorb large amounts of heat at an almost constant temperature. The PCM continues to absorb heat without a significant rise in temperature until all the material is transformed to the liquid phase. When the ambient temperature around a liquid material falls, the PCM solidifies, releasing its stored latent heat. Within the human comfort range between 20-30° C., some PCMs will store five to fourteen times (5-14×) more heat per unit volume than conventional storage materials.

Organic PCMs are particularly applicable to bedding. Organic PCMs pose less health risks to sleepers. Organic PCMs can be paraffin, carbohydrate, or lipid derived.

To provide a PCM that can be added to a surface and that does not dissipate upon liquefying, the PCM is microencapsulated. The PCM should have a latent heat of 170 J/g.

The microcapsules, which start in powder form, are mixed with polyurethane foam to create a durable PCM mixture. The durable PCM mixture is applied to the surface of the solid, resilient, compressible foam block and allowed to cure. The resulting PCM layer is suitably adhered to the foam block and is flexible enough not to crack during use.

The microencapsulated phase change material sold under the trademark ENFINIT® 28 PCM has been found to be particularly applicable. An alternative PCM material that can be microencapsulated and used is described in MacKay US 2012/0193572 A1, which is hereby incorporated by reference.

An object of the invention is to alleviate discomfort felt while sleeping. One way the cooling pillow improves discomfort is through improving air flow. The cooling pillow is formed of aerated gel memory foam, which allows air to circulate and creates a plush more responsive feel than a traditional pillow. The aerated gel memory foam pillows create a current of air when the pillow is compressed. The air current created is greater in an aerated pillow than an unaerated pillow.

The gel memory foam is aerated by incorporating holes throughout the pillow. The holes increase the velocity of the air being pushed from the foam block while the foam block is being compressed. Holes that run from the top surface of the foam block to the bottom surface of the foam block produce a faster gust of air than foam blocks with holes that do not transverse the entirety of the foam block.

An object of the invention is to improve the way in which phase change material is utilized. One way the cooling pillow improves the utilization of phase change material is through innovative application of the phase change material on the surface of the cooling pillow. The cooling pillow incorporates the phase change material in a uniform layer on at least one surface of the pillow.

The cooling pillow is designed for repeated use. In order to withstand the repeated use, the cooling pillow incorporates both an inner pillow protector and an outer pillow cover to create a thin, but protective barrier between the user of the cooling pillow and the phase change material. The pillow protector encloses the foam block.

According to the objects of the invention, the pillow can include a pillow protector. The pillow protector encloses the solid, compressible, resilient foam block. The pillow protector protects the solid, resilient, compressible foam block and the PCM layer from abrasion. The pillow protector is breathable. The material of the pillow protector is selected to maximize the flow of air from the solid, compressible, resilient foam block is compressed while still protecting the pillow during normal use. An example of a breathable material is a scrim. A scrim is a very light textile made from cotton, or sometimes flax. It is lightweight and translucent. A scrim has a rectangular weave that is similar in size in its openings to a window screen. Another type of scrim is called bobbinet/bobbinet. This material has a hexagonal hole shape and comes in a variety of hole sizes.

According to the objects of the invention, the pillow can include a pillow cover. The pillow cover encloses the pillow protector and the solid, compressible, resilient foam block. The pillow cover can include a closure such as a zipper at one end to removably secure the foam block and the pillow protector inside the pillow cover. To maximize the gust of cooled air that is created when the PCM-covered surface is pressed, a lightweight performance fabric forms a breathable panel of the pillow cover. The breathable panel is placed over the PCM-covered surface.

The portion of the pillow case that overlies the phase change material can be made of a performance fabric. The performance fabric improves the cooling of the pillow by minimizing the blockage of air-flow from the pillow as the pillow is being compressed. The performance fabric is improved compared to natural fiber covers, particularly cotton. In addition, the performance fiber transfers heat (i.e. cool) better than natural fibers. The performance fiber is also cool to the touch. The performance fiber wicks moisture and perspiration from the user's skin. Inner layer of cover The sewing pattern on one side of the outer pillow cover is shaped in a specialized pattern, with increased thickness regions in some areas, and decreased thickness regions in the spaces between the increased thickness regions.

The sewing pattern on the opposite side of the outer pillow cover is uniform in thickness. The thickness of this side of the outer pillow cover is equal to the thickness of the decreased thickness regions on the patterned outer pillow cover side.

The rear (i.e. not facing the phase-change side) of the pillow cover can be composed of cotton.

It is an object of the current invention to allow for the phase change material to regulate adequately the user's temperature. One way in which the phase change material is adequately utilized is through controlling the thickness of both the inner pillow cover and the outer pillow cover to allow the user's temperature to be responsively observed by the phase change material to allow the material to both absorb and release heat as needed.

In accordance with the objects of the invention, the phase change material layer, located on at least one side of the foam pillow, is arranged to underlie the side of the pillow cover with uniform thickness. By having the phase change material layer underlie the uniform thickness side of the pillow cover, the degree of separation between the user and the phase change material is minimized. This allows for the phase change material to adequately respond to the thermal needs of the user.

It is an object of the current invention to provide a cooling sensation to the user, which will increase comfort levels. One way in which cooling is provided to the user is through the aeration in the pillow. With the use of aerated gel foam, the pillow provides a release of air in an outward motion when compressed. This release of air, combined with the phase change material, cools the user's head with a gust of cooled air when the pillow is compressed, thus increasing comfortability.

In order to improve the wear of the foam block, a pillow protector is used to enclose the foam block. The pillow protector and foam block can be removed, together, from the pillow cover.

One object of the current invention is to maintain a sustained comfortable thermal environment in order to provide quality sleep. The cooling pillow provides a maintained thermal environment, within an ideal temperature range, with the phase change material layer. The phase change material melts when the temperature increases above the range, and solidifies when the temperature decreases beneath the range. This melting and solidifying of the phase change material absorbs and releases heat as needed to provide a controlled thermal environment for the user.

Other features of the invention are set forth in the appended claims.

Although the invention is illustrated and described herein as embodied the invention is not limited to the details shown because various modifications and structural changes may be made without departing from the invention and the equivalents of the claims. However, the construction and method of operation of the invention together with additional objects and advantages thereof will be best understood from the following description of specific embodiments when read in connection with the accompanying drawings.

DETAILED DESCRIPTION OF THE INVENTION

Figure 1:
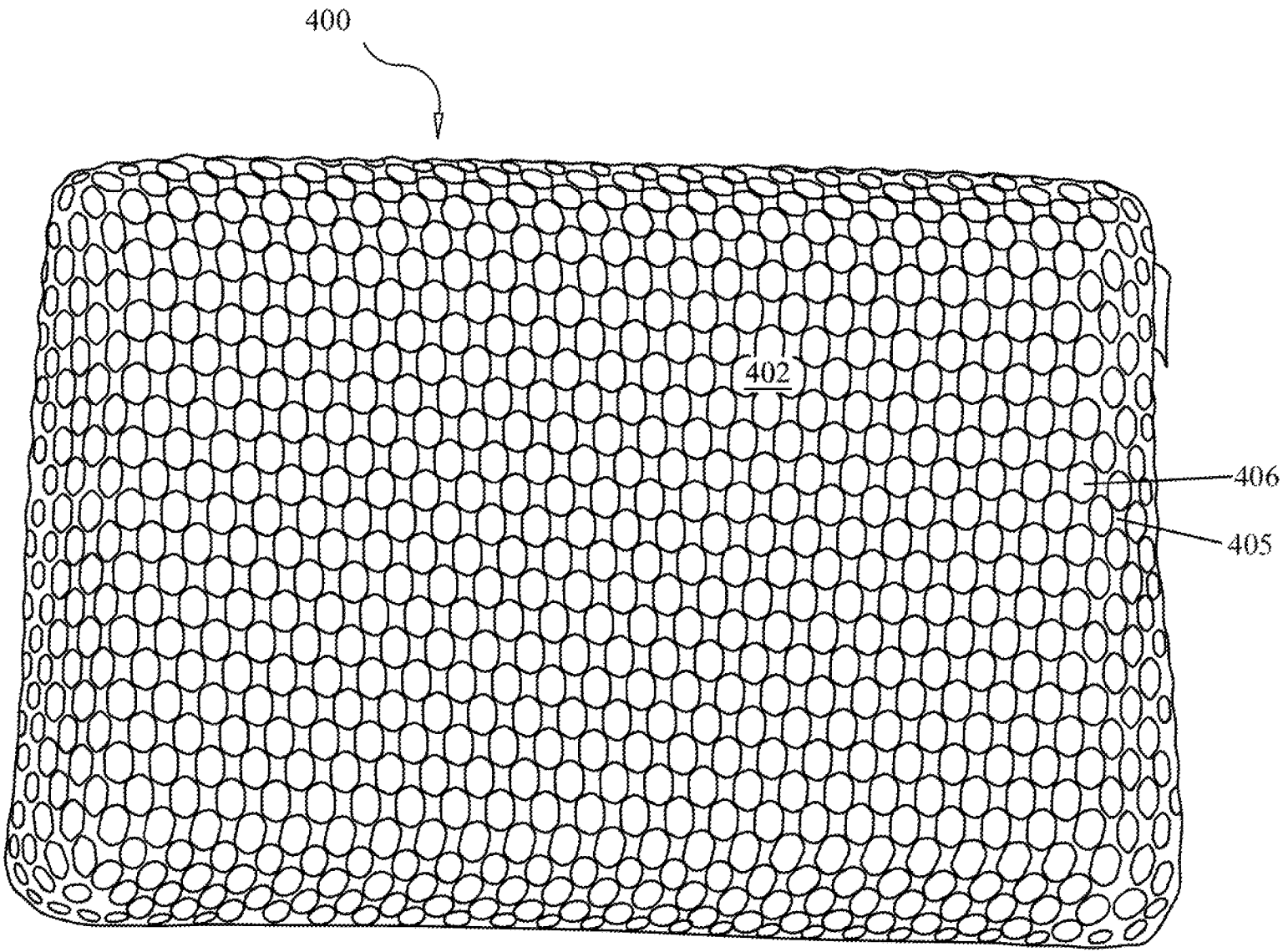
FIG. 1 is a bottom elevational view of a cooling pillow according to the invention.

Reference numbers are used consistently throughout the figures of the drawing unless otherwise described. While the present invention is described with respect to what is presently considered to be the best mode, the invention as claimed should not be limited to the embodiments that are shown and described. Furthermore, the invention is not limited to the particular methodology, materials, and modifications described in this section. The terminology used herein is for the purpose of describing exemplary embodiments of the invention.

FIGS. 1-9 show a preferred embodiment of a cooing pillow 100. In FIG. 1, a patterned side 402 of a pillow cover 400 is shown. The patterned side 402 is textured by having material of different thicknesses. The patterned side 402 has evenly spaced thicker regions 406 separated by evenly spaced thinner regions 405. The thicker regions 406 are hexagonal shaped. The thicker regions 406 are four millimeters (4 mm) thick. The thinner regions 405 are two millimeters (2 mm) thick. The pillow cover is made from cotton. The patterned side 402 provides a plush surface. In this preferred embodiment, the patterned side 402 is not optimized to maximize cooling.

The user of the cooling pillow 100 may choose to sleep with either side of the cooling pillow 100 facing upward. In certain climates, the user may prefer to utilize the patterned side 402 of the pillow cover 400 to rest his or her head. The patterned side 402, by having increased and decreased thickness regions equally spaced, creates a soothing sensation for the user. Also, the patterned side 402, by having increased thickness relative to the uniform side 403 (which is shown in FIG. 2) of the pillow cover 400, allows for decreased cooling, which may be preferable to certain users or in certain situations.

Figure 2:
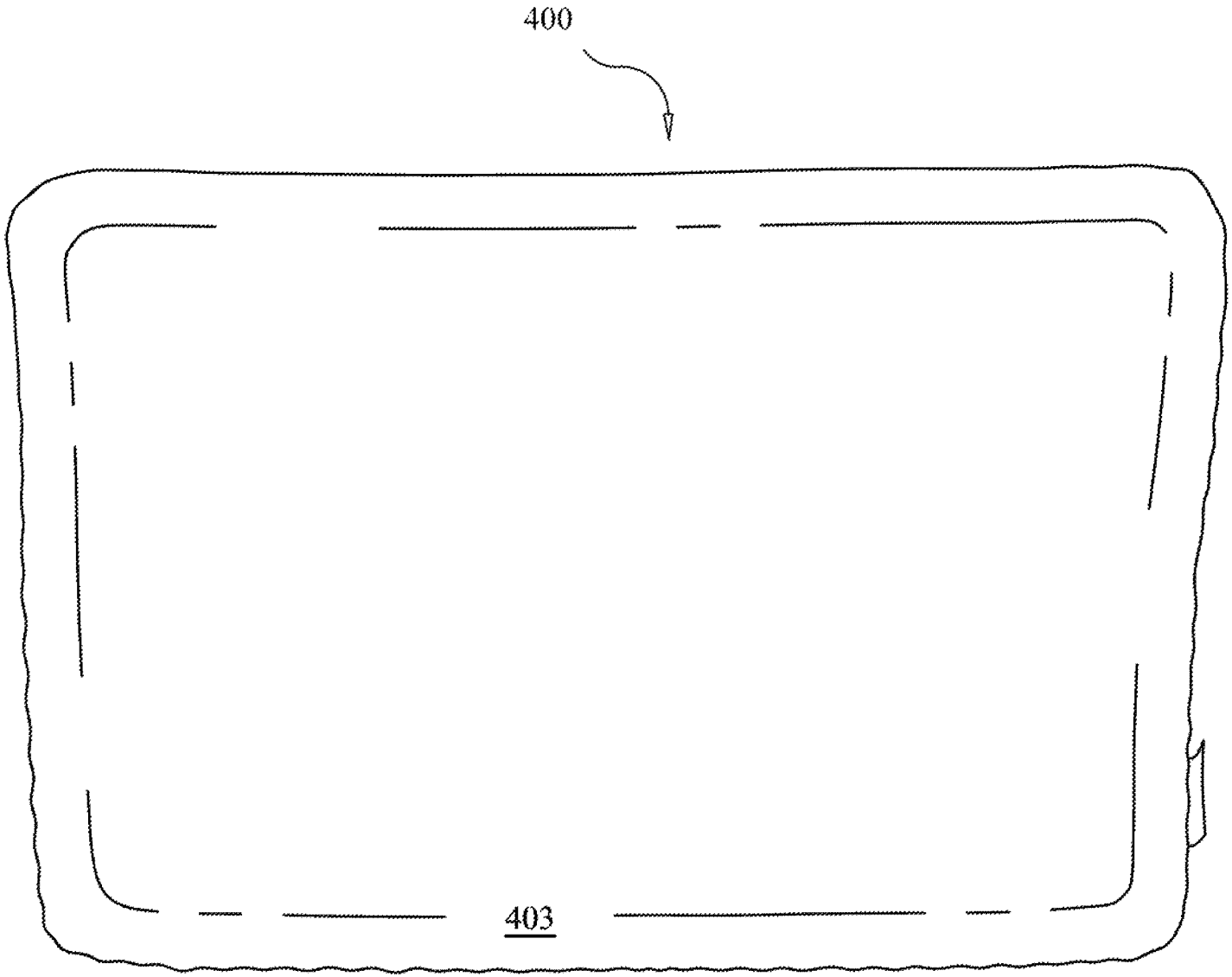
FIG. 2 is a top elevational view of the cooling pillow shown in FIG. 1 with a pillow cover removed.

FIG. 2 shows the uniform side 403 of the pillow cover 400. The uniform side 403 is made from a performance fabric. The preferred embodiment of performance fabric is an elastane/polyester blend.

Figure 4:
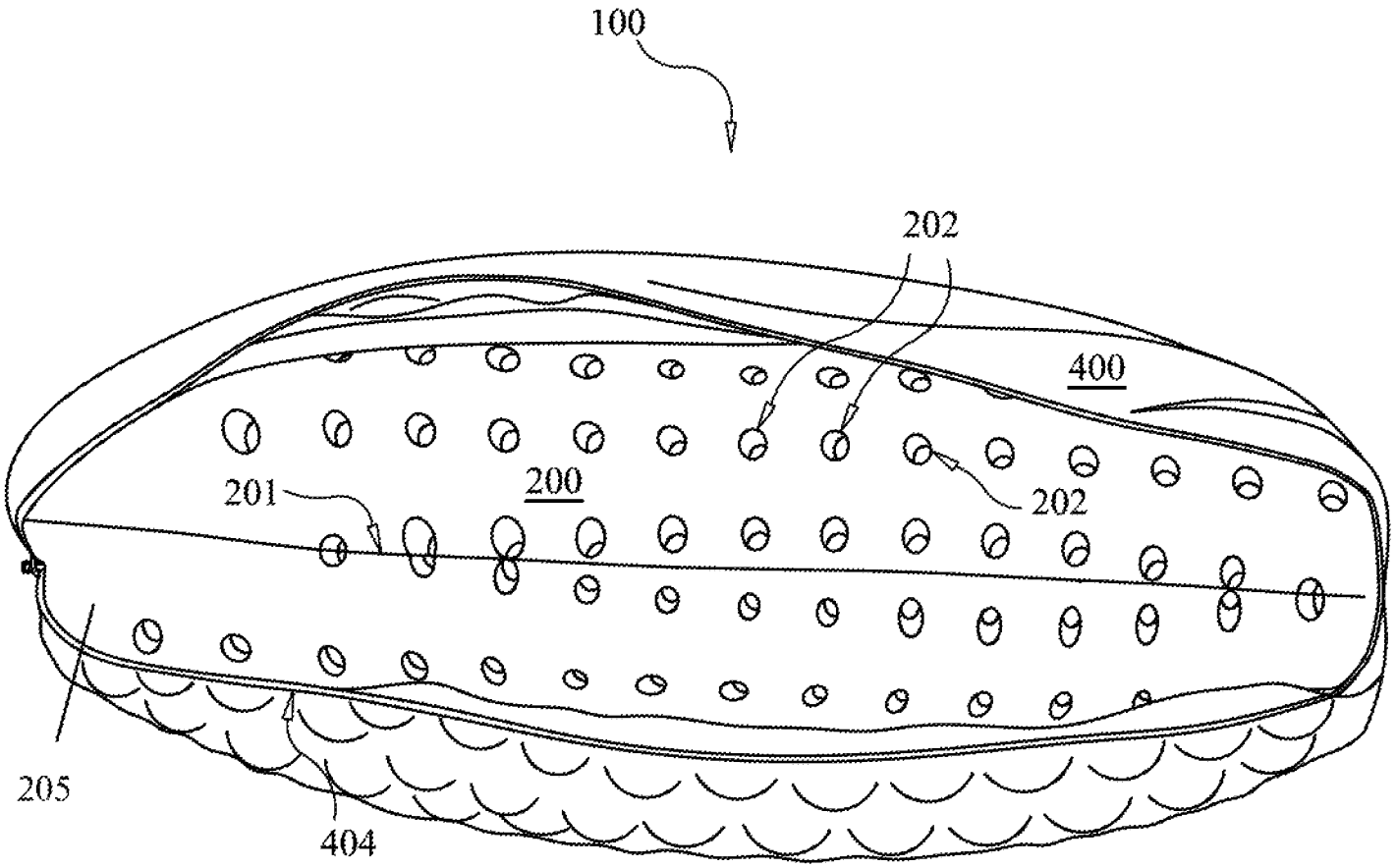
FIG. 4 is a left elevational view of the cooling pillow shown in FIG. 1 with the pillow protector and the pillow protector opened to expose the foam block.
Figure 5:
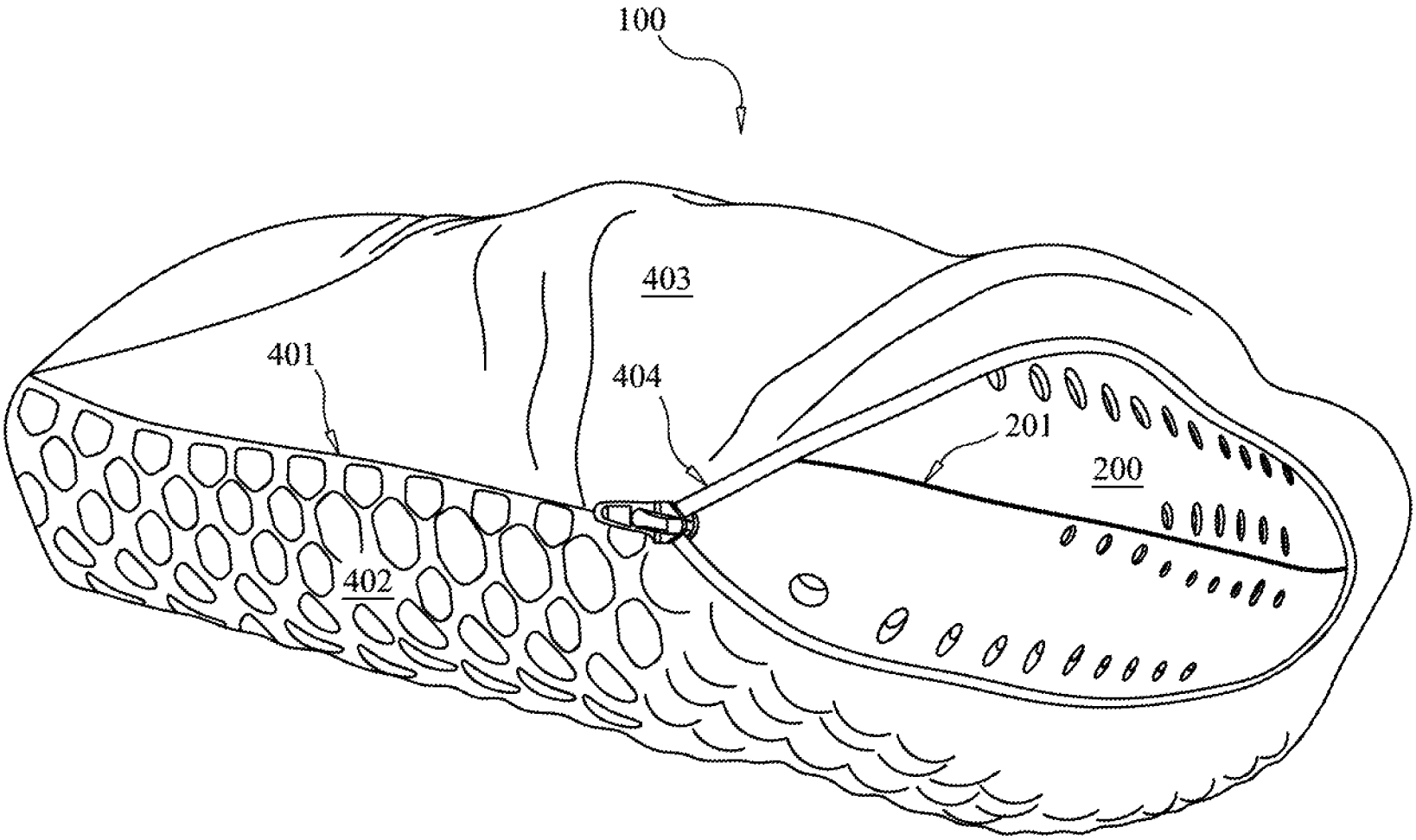
FIG. 5 is a left, top, front perspective view of the cooing pillow shown in FIG. 4.
Figure 6:
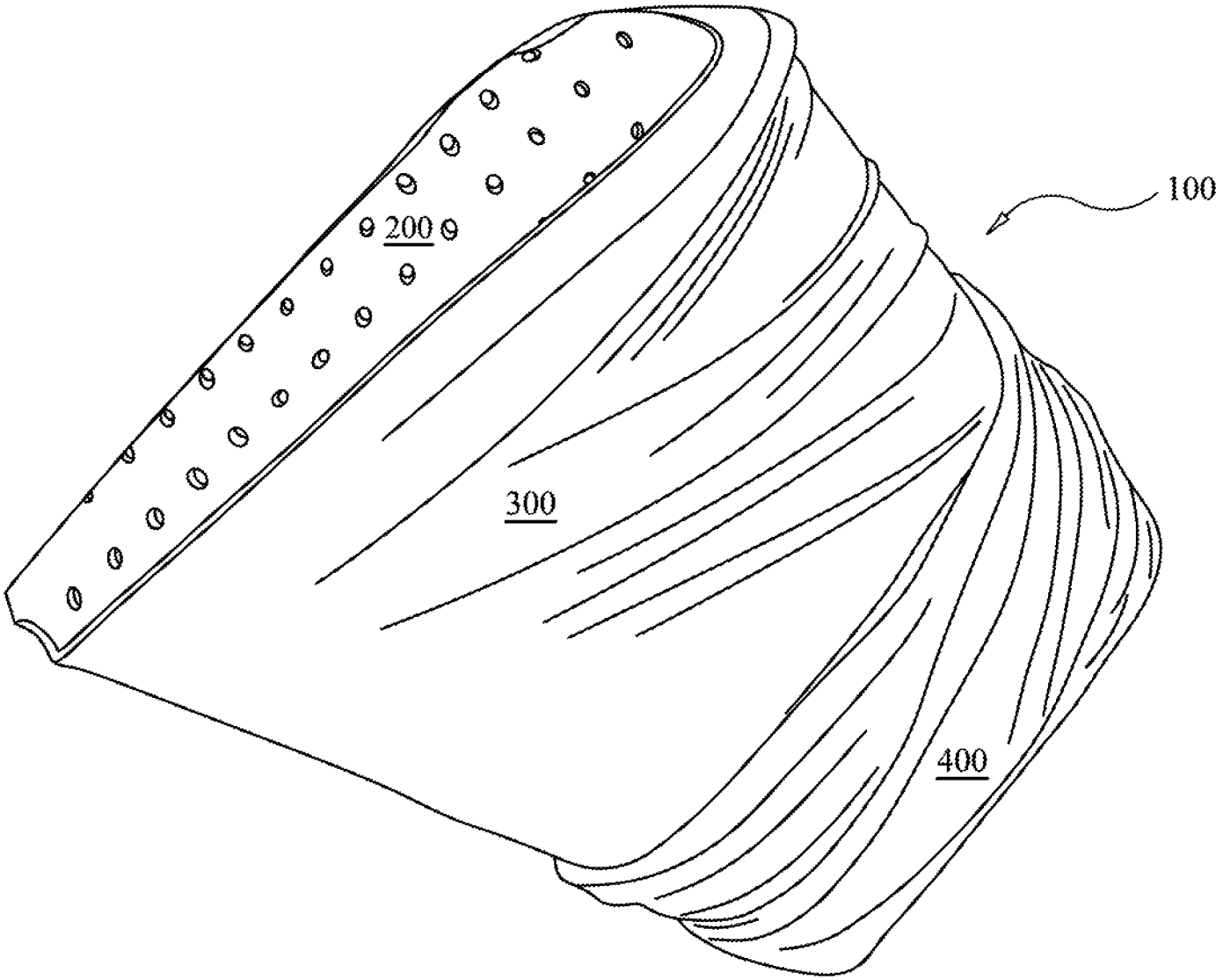
FIG. 6 is a left, top, rear perspective view of the cooling pillow shown in FIG. 1 with the pillow case retracted and the pillow protector partially retracted.

FIG. 6 shows a pillow protector 300. The pillow protector 300 is a scrim. The scrim is made from a lightweight cotton cloth. The pillow protector 300 encloses the foam block 200. Note: for purposes of showing the foam block 200, FIGS. 4-9 show the pillow protector 300 opened and partially retracted; however, in the actual preferred embodiment, the pillow protector 300 is sewn closed. The pillow protector 300 and the foam block 200 are placed within the pillow cover 400. The pillow protector 300 eases the removal of the pillow protector/foam block from the pillow cover 400 because the cotton fabric of the pillow protector 300 has a lower coefficient of friction than the foam block 200. In addition, the pillow protector protects the foam block 200 and the cooling layer 203 by preventing abrasion on the foam block 200 as the pillow protector/foam block are being pulled from a snug fitting pillow cover 400.

Figure 3:
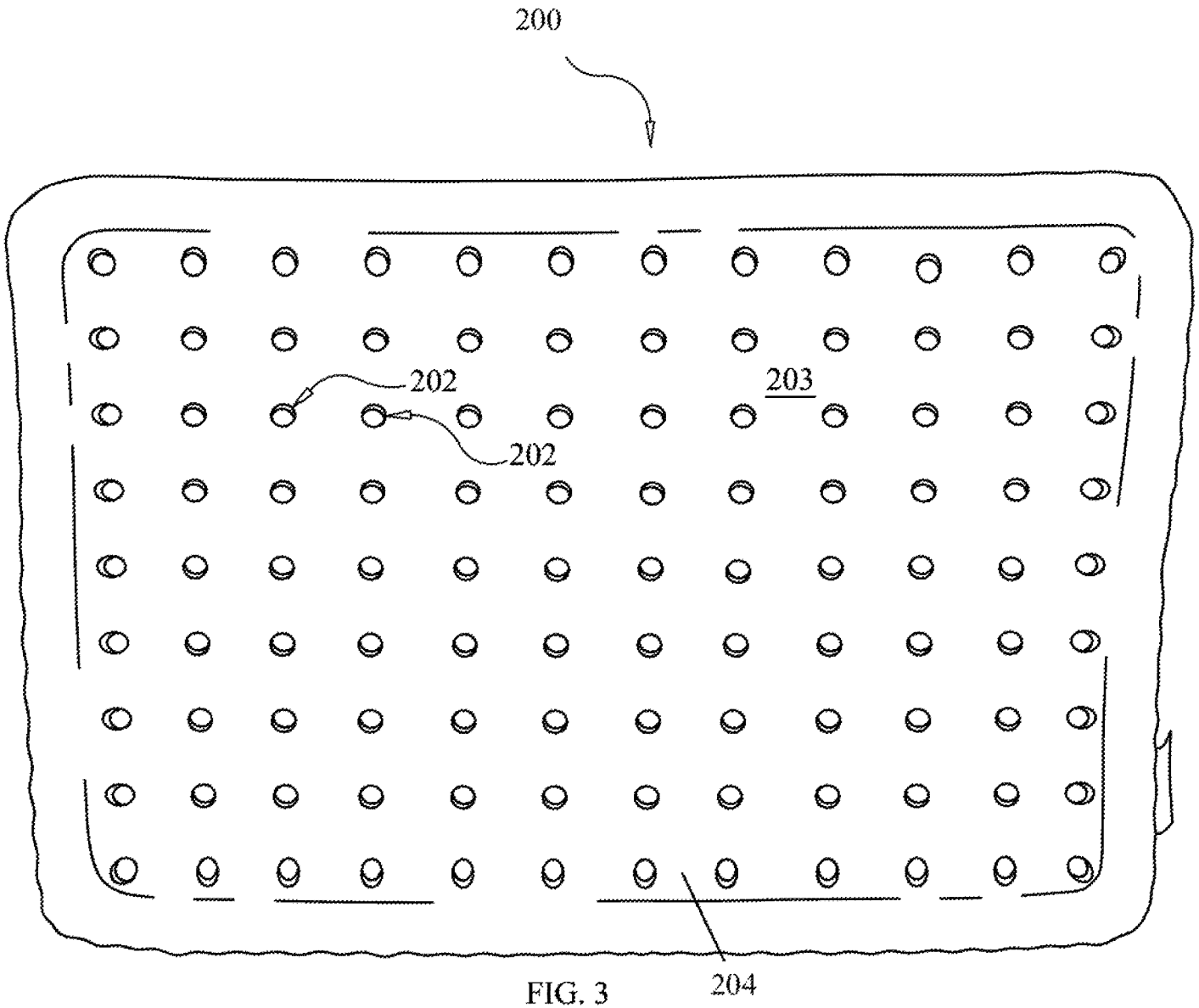
FIG. 3 is a top elevational view of the cooling pillow shown in FIG. 1 with a pillow case and pillow protector removed.

FIG. 3 shows a foam block 200. The foam block 200 is made from solid, resilient, compressible foam. A preferred type of foam is polyurethane foam. Alternate types of foam include viscoelastic foams and gel-infused polyurethane foams. The foam block 200 has a top surface 204. To obtain the best cooling effect, a user places her or his head on the top surface 204 of the cooling pillow 100.

A plurality of holes 202 are formed through the foam block 200. The holes 202 run parallel to each other. The holes 202 transverse the foam block 200; that is, the holes 202 are formed in the top surface 204, through the foam block 200 itself, and in the bottom surface. The bottom surface is not shown in FIG. 3. The holes 202 have a frustoconical shape. Throughout their lengths, the holes 202 have a circular cross section. At the top surface 204, the holes 202 have a diameter of one centimeter (1 cm). At the bottom surface, the holes 202 have a diameter of six tenths of a centimeter (0.6 cm). The holes 202 are formed in a repeating square pattern. The holes 202 are center-spaced twenty-five centimeters (25 cm) apart from each other. As shown in FIG. 4, a seam 201 separates the foam block 200 into the top surface 204 and the bottom surface 205.

A cooling layer 203 is disposed on the top surface 203. The cooling layer 203 includes microencapsulated phase change materials. A preferred embodiment of the microencapsulated phase change materials is sold under the trademark ENFINIT® 28 PCM. Phase change materials can be abbreviated by the acronym PCM. The microcapsules of PCM are formed using thin, impermeable acrylic capsule walls. The capsule size range from eight to ten micrometers (8-10 μm), with a median particle size of ten micrometers (10 μm). The capsules have a core to wall ration of 80-95% core to 5-20% wall. The microencapsulation system sold under the trademark ENCAPSYS® is a preferred microencapsulation system. A microencapsulated PCM with a heat capacity of 186 joules/gram, an onset melting temperature of 27° C. and an onset crystallization temperature of 27° C. is preferred. The preferred PCM that is included in the microcapsules is a glycerin-based phase change material. The microencapsulated PCM is mixed with polyurethane and adhered to the top surface 204. When preparing the cooling layer 203, the weight ratio of microencapsulated PCM to polyurethane is 2:3-3:7. After curing, the cooling layer 203 has a thickness of one to two millimeters (1-2 mm). An alternate example of a suitable PCM is described in US patent publication MacKay, US 2012/0193572 A1, which is hereby incorporated by reference.

In another embodiment, which is not shown, holes that do not reach the opposing surface (i.e. bottom surface) may be made in the top surface 203.

Placing the uniform side 403 of the pillow cover 400 over the cooling layer 203 increases the heat transfer between the user's head and the pillow 100 in two ways. First, overlying the cooling layer 203 with the uniform side 403 increases convection. Because the uniform side 403 is thinner than the patterned side 402 and because the uniform side 403 is made from a material that blocks less wind than the patterned side 402, the gust of air that reaches the user's head relative is increased. Second, overlying the cooling layer 203 with the uniform side 403 increases conduction because the uniform side 403 is less insulating than the thicker patterned side 402.

Despite the decreased heat transfer and additional cost of materials, in an alternative embodiment, which is not shown, the cooling layer can adhere to the surfaces of both sides of the pillow.

FIGS. 4-9 show the cooling pillow 100 with its various layers retracted or removed to show their location relative to each other. The cooling pillow 100 is the combination of the foam block 200, the pillow protector 300 (as shown in FIG. 6), and the pillow cover 400. Note, in actual use, the pillow protector 300 is sewn closed and cannot be retracted.

In the preferred embodiment, the foam block 200 is formed of aerated gel foam. When formed, the foam block 200 has holes 202, and a seam 201. The holes 202 extend from one side of the foam block 200 to the other, with the seam 201 separating the sides. The foam block 200 is releasably held within the pillow cover 400 by a zipper opening 404. The user of the cooling pillow 100 may remove the foam block 200 from within the pillow cover 400 in order to switch the side of the pillow cover 400 that the cooling layer 203 is exposed to, or to wash the pillow cover 400.

FIG. 5 shows the cooling pillow 100 inside of the pillow cover 400, with the zipper opening 404 in an open position. The seam 201 of the foam block 200 aligns with the seam 401 of the pillow cover 400. The cooling pillow 100 is shown in an upward position that, in the preferred embodiment, would be the position in which the user would sleep on the pillow 100. The uniform side 403 of the pillow cover 400 is directed towards the top of the cooling pillow 100, and the patterned side 402 of the pillow cover 400 is directed toward the bottom of the cooling pillow 100. In the preferred embodiment, the cooling layer 203 (as shown in FIG. 3) is exposed to the uniform side 403 of the outer cover 400 of the cooling pillow 100. The user places his or her head on the uniform side 403 of the cooling pillow 100 while sleeping. In other embodiments, not shown, the user may reverse the side that the cooling layer 203 is exposed to. In the other embodiments, not shown, the cooling layer 203 may be exposed to the patterned side 402 of the pillow cover 400.

FIG. 6 shows the various components of the cooling pillow 100. The foam block 200 is the most interior of the components, with the pillow protector 300 enclosing the foam block 200. The pillow cover 400 encloses the pillow protector 300. In the preferred embodiment, the pillow cover 400 has differing thicknesses on either side (as shown in FIG. 5).

The foam block 200 that is shown in FIG. 3 can be used or sold without a pillow protector 300 or pillow case.

In an alternate embodiment that is not shown, the pillow protector 300 is not included. In this alternate embodiment, the foam block 200 is enclosed directly within the pillow case 400.

In an alternate embodiment that is not shown, the pillow case 400 is not included. In this alternate embodiment, the foam block 200 is enclosed within the pillow protector 300.

Figure 7:
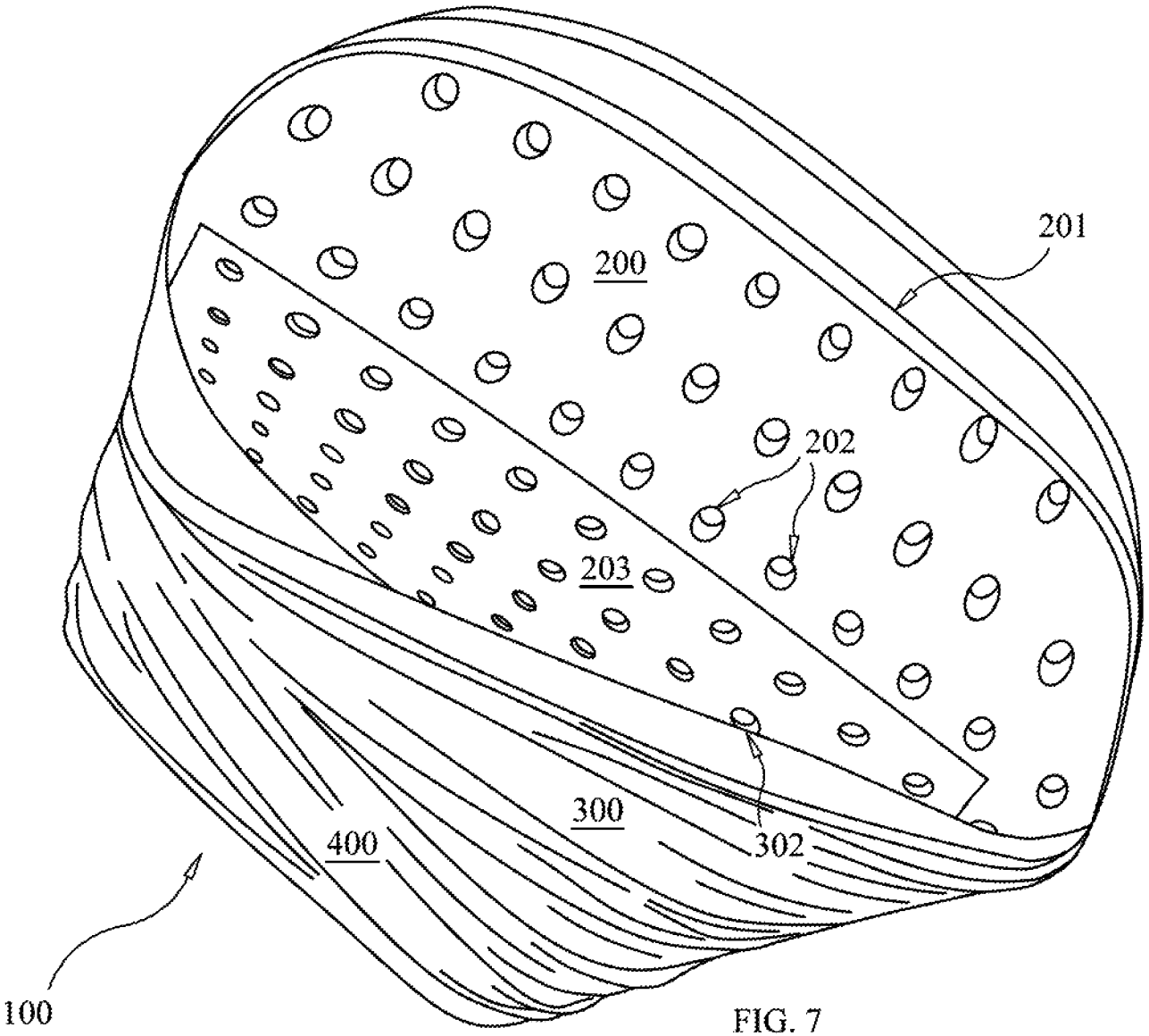
FIG. 7 is a first alternate left, top, front perspective view of the cooling pillow shown in FIG. 6 with the outer and inner cover retracted to expose the cooling layer on the foam block.

FIG. 7 shows the left end of the cooling pillow 100 with the opening 302 of the pillow protector 300 in an open position, exposing the foam block 200 beneath. The pillow cover 400 is shown enclosing the pillow protector 300. The cooling layer 203 located on the surface of the foam block 200 is shown facing outward. In the preferred embodiment, the holes 202 in the surface of the foam block 200 extend through the cooling layer 203. In the embodiment shown, the cooling layer 203 is rectangular in shape. In the embodiment shown, the cooling layer 203 is located on one surface of the foam block 200. The cooling layer 203 in the preferred embodiment is outward facing, toward the uniform side 403 of the pillow cover 400.

In alternate embodiments that are not illustrated, the shape of the cooling layer 203 may vary without departing from the invention. In other embodiments, the cooling pillow 100 may incorporate multiple cooling layers 203, for instance, a further cooling layer may match the cooling layer that is depicted in the preferred embodiment and be exposed toward the patterned side 402 of the outer cover 400.

Figure 8:
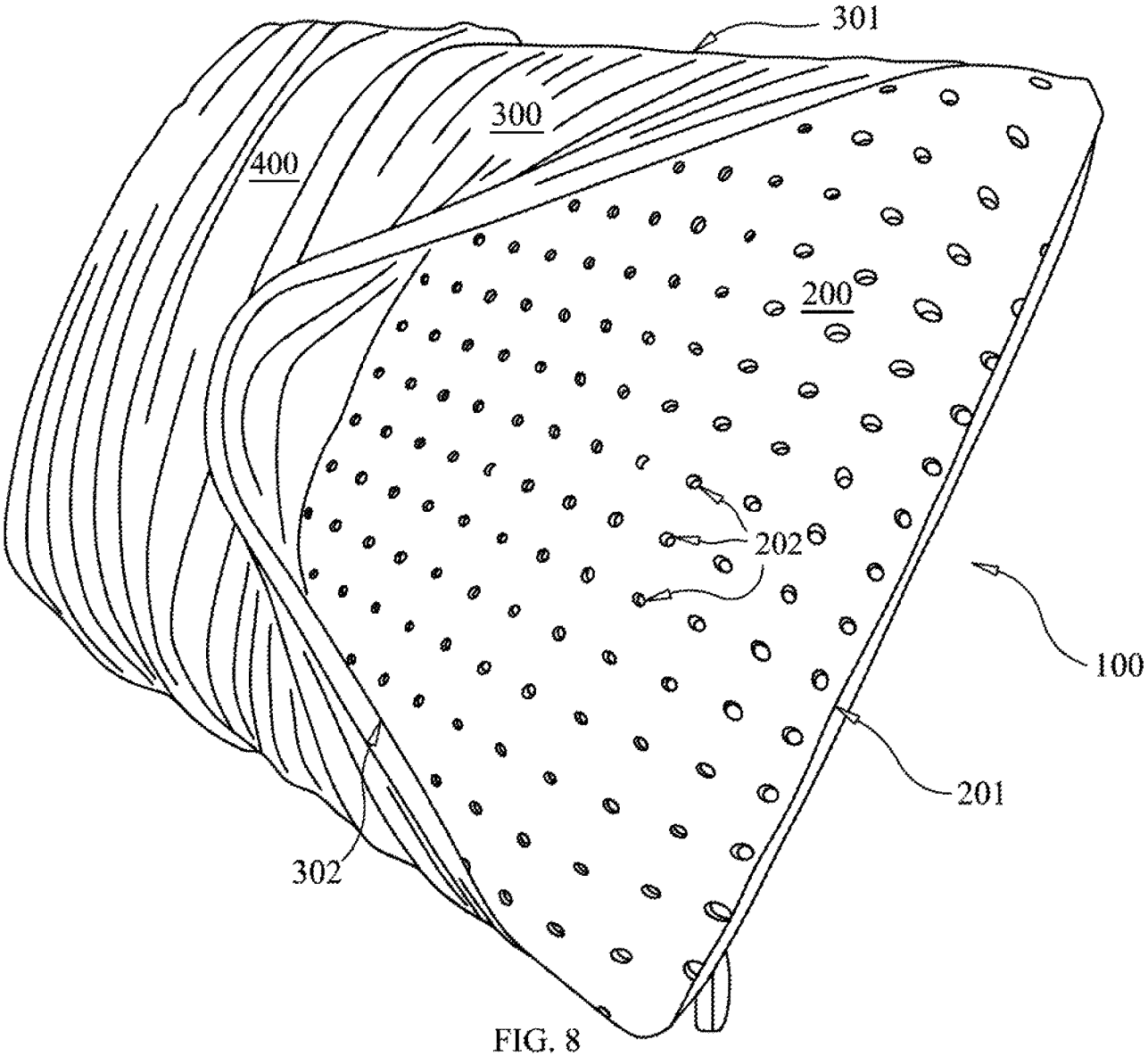
FIG. 8 is a second left, top, front perspective view of the cooling pillow shown in FIG. 7.

FIG. 8 shows the preferred embodiment of the cooling pillow 100. The pillow cover 400 is pulled down below the pillow protector 300, and the pillow protector 300 is pulled down through the opening 302 of the pillow protector 300, exposing the foam block 200. The seam 301 of the pillow protector 300 aligns with the seam 201 of the foam block 200. The side of the foam block 200 shown is the absent the cooling layer 203. The cooling layer, in the embodiment shown, is exposed to the back side of the foam block 200, causing it not be able to be seen. When in use, the pillow protector 300 is pulled upward toward the exposed end of the foam block 200, and the pillow cover 400 is pulled upward in a similar fashion to encompass the pillow protector 300. The cooling pillow 100, when in use does not expose the holes 202 outside of the pillow protector 300 or the pillow cover 400. Instead, when compressed, the holes 202 release air in an outward direction, toward the user through both the pillow protector 300 and the pillow cover 400. This release of air, in combination with the cooling layer 203, creates increased comfortability to for the user.

Figure 9:
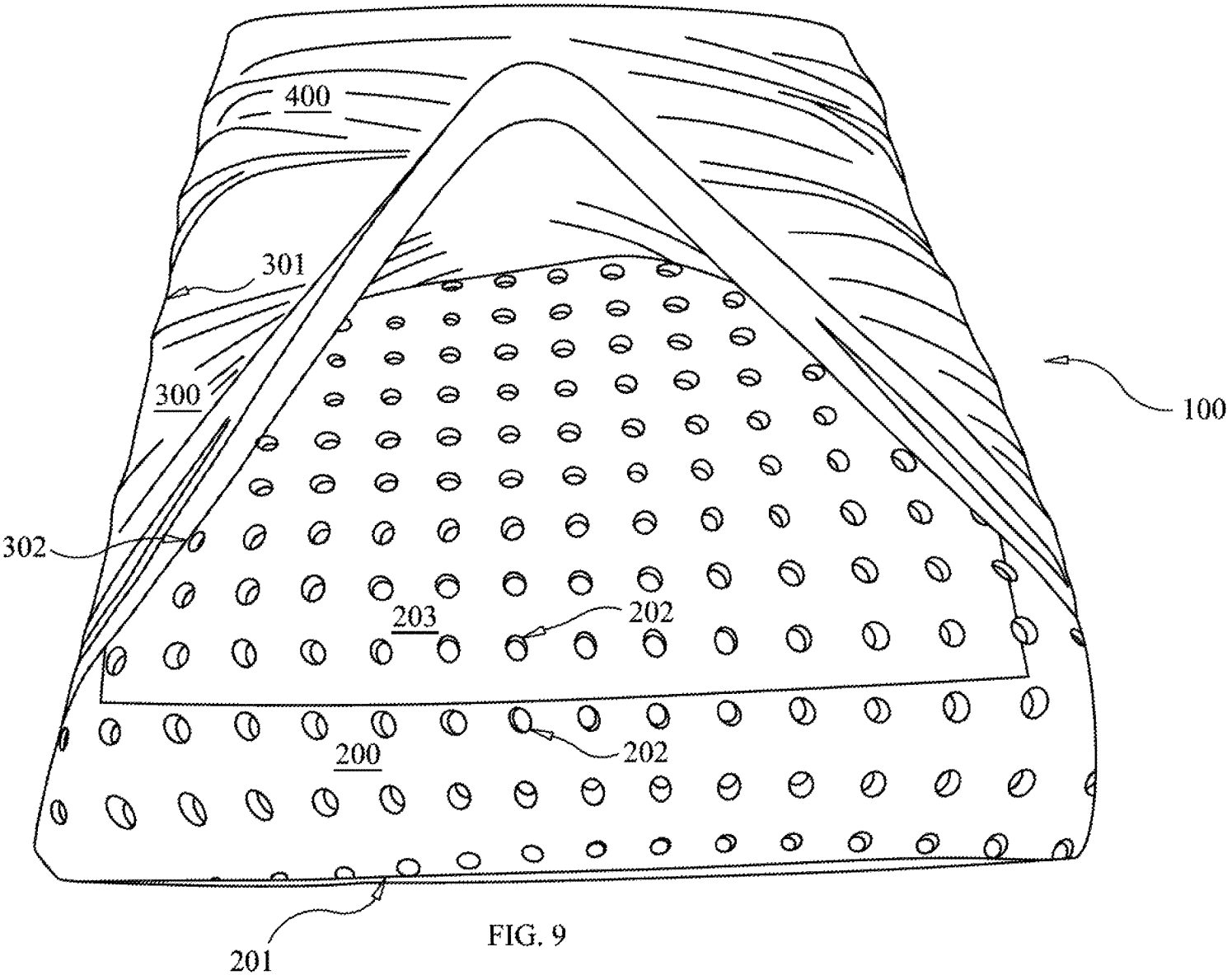
FIG. 9 is a left, top perspective view of the cooling pillow shown in FIG. 6.

FIG. 9 shows the reversed side of the cooling pillow 100 that was depicted in FIG. 8. The pillow cover 400 is pulled down below the inner pillow cover, and the pillow protector 300 is both lifted upward away from the pillow, and pulled down toward the end of the foam block 200 opposite of the end of the opening 302, exposing the foam block 200 beneath. The cooling layer 203 is shown in a rectangular shape on the surface of the foam block 200. The holes 202 in the foam block 200 are shown extending through the foam block 200 and the cooling layer 203. The seam 201 of the foam block 200 aligns with the seam 301 of the inner cover 300 to allow the inner cover 300 to be straight in relation to the foam block 200 when pulled up. The opening 302 of the inner cover 300 allows for the foam block 200 to be removed. The foam block 200 may need to be removed from the pillow protector 300 and the pillow cover 400 to allow for either the pillow protector 300 or the pillow cover 400 to be washed.

A preferred embodiment of a process for making a cooling pillow includes the following steps. A conventional mixture of materials for forming a solid, resilient, compressible polyurethane foam is prepared. Before pouring the mixture into the mold, a mold releasing agent is sprayed on the surface of the mold. Next, the mixture is poured into a mold. The mold has the shape of the desired pillow. A preferred size pillow is 41 cm by 61 cm by 14 cm. Next, the mold is heated to 51.7° C. The temperature of the mold is held at 51.7° C. for at least ten minutes and no more than twelve minutes. After the time expires, a block of solid, resilient, compressible polyurethane that is shaped like the mold is removed from the mold.

The foam block is "cracked" twice to improve the feel of the pillow. To crack the pillow, the pillow is run between a set of rollers.

Holes are formed in the foam block according to the following steps. First the foam block is compressed by pressing the top surface of the foam block toward the bottom surface. Next, an array of punches are pressed against the top surface of the compressed pillow to form holes that transverse the foam block from the top surface to the bottom surface. The resulting holes will have a frustoconical shape. The holes have a diameter of one centimeter at the top surface. The holes have a diameter of 0.6 cm at the bottom surface. The holes are formed in a repeating rectangular pattern in which the holes are center spaced 2.5 cm apart from each other.

The phase change material is purchased in a microencapsulated state. The preferred phase change material is sold under the trademark ENFINIT® 28 PCM. The PCM is mixed with a batch of the above-described polyurethane material. The weight ratio of microencapsulated PCM to polyurethane is 2:3-3:7. The PCM-polyurethane mixture is applied in two coats to the top surface of the foam block. Each coat is cured by reheating the painted foam block to 51.6° C. for ten to twelve minutes. The resulting cooling layer is between one and two millimeters (1-2 mm) thick.

To complete the cooling pillow, the foam block with cooling layer is placed within a pillow protector. The pillow protector is stitched close. The pillow protector, which houses the foam block with cooling layer, is inserted into the pillow case. When the pillow protector is inserted, the top surface of the foam block, on which the cooling layer is applied, is oriented to underlie the uniform side of the pillow cover.

The process for making the cooling pillow is conducted under standard laboratory conditions unless otherwise specified.

A preferred embodiment of a process for using the cooling pillow includes the following steps. To begin, the pillow protector 300, which holds the foam block 200 with cooling layer 203, is inserted within a pillow case 400 so that the cooling layer 203 is oriented beneath the uniform side 403 of the pillow cover 400. Next, the cooling pillow 100 is placed on a surface (for example, a bed top) with the uniform side 403 of the pillow case and the cooling layer 203 facing upward. A user then compresses the cooling pillow 100 by applying pressure against the uniform side 403. Typically, the pressure is applied by resting the user's head on the uniform side 403. As the cooling pillow 100 compresses, a rush of air that is cooled by the cooling layer 203 passes through the pillow protector 300, through the uniform side 403, and onto the head and neck of the user. The user continues to rest his or her head on the compressed pillow while sleeping.

If the user wants an additional gust of cooled air, the user lifts his or her head from the uniform side 403 and allows the foam block 200 to expand to its original shape. After the foam bock 200 is expanded, the user places his or head against the uniform side 403 to compress the foam block 200 and create another gust of air.

What is claimed is:

1. A process for manufacturing bedding, which comprises:

providing a solid, resilient, compressible foam block, said block having a surface;

applying phase change material to said surface;

forming a hole into said block and through said surface; and cracking said block.

2. A process for manufacturing bedding, which comprises:

providing a solid, resilient, compressible foam block, said block having a surface;

applying phase change material to said surface;

forming a hole into said block and through said surface;

compressing said block by pressing on said surface before the forming of the hole; and performing the forming of the hole while said block is compressed.

* * * * *